US006848461B2

(12) United States Patent
Tsai

(10) Patent No.: US 6,848,461 B2
(45) Date of Patent: Feb. 1, 2005

(54) TENT STRUCTURE

(76) Inventor: Tony Tsai, 4F-3, No. 8, Fu Ching St., Taipei (TW)

( * ) Notice: Subject to any disclaimer, the term of this patent is extended or adjusted under 35 U.S.C. 154(b) by 0 days.

(21) Appl. No.: 10/351,372

(22) Filed: Jan. 27, 2003

(65) Prior Publication Data

US 2004/0144412 A1 Jul. 29, 2004

(51) Int. Cl.[7] ..... E04H 15/50
(52) U.S. Cl. ..... 135/131; 135/145; 135/153
(58) Field of Search ..... 135/131, 130, 135/135, 136, 139–147, 153, 155, 159, 160, 909

(56) References Cited

U.S. PATENT DOCUMENTS 1,602,980 A * 10/1926 Louis ..... 135/96
2,555,220 A * 5/1951 Brown ..... 135/139
5,511,572 A * 4/1996 Carter ..... 135/145
5,638,853 A * 6/1997 Tsai ..... 135/145
5,701,923 A * 12/1997 Losi et al. ..... 135/131
5,797,412 A * 8/1998 Carter ..... 135/145
5,921,260 A * 7/1999 Carter ..... 135/145
6,035,877 A * 3/2000 Losi et al. ..... 135/131
6,076,312 A * 6/2000 Carter ..... 52/145
6,240,940 B1 * 6/2001 Carter ..... 135/145
6,382,224 B1 * 5/2002 Carter ..... 135/145
6,431,193 B2 * 8/2002 Carter ..... 135/145
6,470,902 B1 * 10/2002 Carter ..... 135/145
6,502,597 B2 * 1/2003 Carter ..... 135/145
6,601,599 B2 * 8/2003 Carter ..... 135/145
6,666,223 B2 * 12/2003 Price et al. ..... 135/131
6,701,949 B2 * 3/2004 Carter ..... 135/145
2004/0020526 A1 * 2/2004 Deng ..... 135/131

FOREIGN PATENT DOCUMENTS

GB 2321913 A * 8/1998

* cited by examiner

*Primary Examiner*—Ramon O. Ramirez
*Assistant Examiner*—Naschica S. Morrison
(74) *Attorney, Agent, or Firm*—Rosenberg, Klein & Lee

(57) ABSTRACT

A tent structure includes four posts, four scissor-like linking rod sets, four retractable rod sets and a connector. The four posts are placed on four corners of the tent to form a square structure. Each post comprises a fixture at the top portion with a sleeve thereon at an upper portion and a sliding seat thereon at a lower portion. The sliding seat comprises a supporting rod. The four scissor-like linking rod sets are secured between the posts, respectively. One end of each retractable rod set is inserted through the sleeve of each post and the other end of the retractable rod set is pivoted to the connector, thus when the posts are expanded outwardly, the scissor-like linking rod sets are also expanded to form an arcuate tent.

6 Claims, 9 Drawing Sheets

TENT STRUCTURE

FIELD OF THE INVENTION

This invention relates to a tent, and more particularly, to a tent with extending flexibility and sustainability.

BACKGROUND OF THE INVENTION

There are various tents on the market, most of which are of the enclosed type, which is to cover a structure with a canopy with one side left open for air flow, and the center top portion is supported by four pillars on four corners to raise upwardly at the connecting portion. However, this structure is not strong enough and will be bent inwardly at the top center portion, which collects water when it rains and gains more weight to the tent.

In view of the above shortcoming, this inventor had invented a new design in U.S. Pat. No. 5,638,853, which has the four pillars standing straight, and each pillar has a vertical retractable scissor-like rod thereon, which is connected with each other to form a square shape structure. Each pillar comprises a fixture and a sliding seat adapted to connect with the free end of the scissor-like rod. Each of the fixture and the sliding seat comprises a connecting device to connect a nod rod and a linking rod, the linking rod having one end connected to a sleeve on the nod rod, which is capable of bending towards one direction that forms a cross support to form the tent top. However, this design also comprises some shortcomings, such as:

1. The top is not in arcuate shape, which cannot facilitate draining water and can hardly minimize wind.
2. The retractable rod set has no support.
3. It's not easy to collapse and to expand, and also provides no convenience in storage and carrying.

SUMMARY OF THE INVENTION

It is the primary object of the present invention to provide a tent structure, which is easy to operate and has a better flexibility to form an arcuate top to facilitate draining rain and to minimize wind.

It is another object of the present invention to provide a tent structure, which provides a support on the retractable rod to enhance the structure of the tent.

It is a further object of the present invention to provide a tent structure, which is easy to expand and to collapse, and has a compact size for ease in storing and carrying.

DETAILED DESCRIPTION OF THE PREFERRED EMBODIMENT

Figure 1:
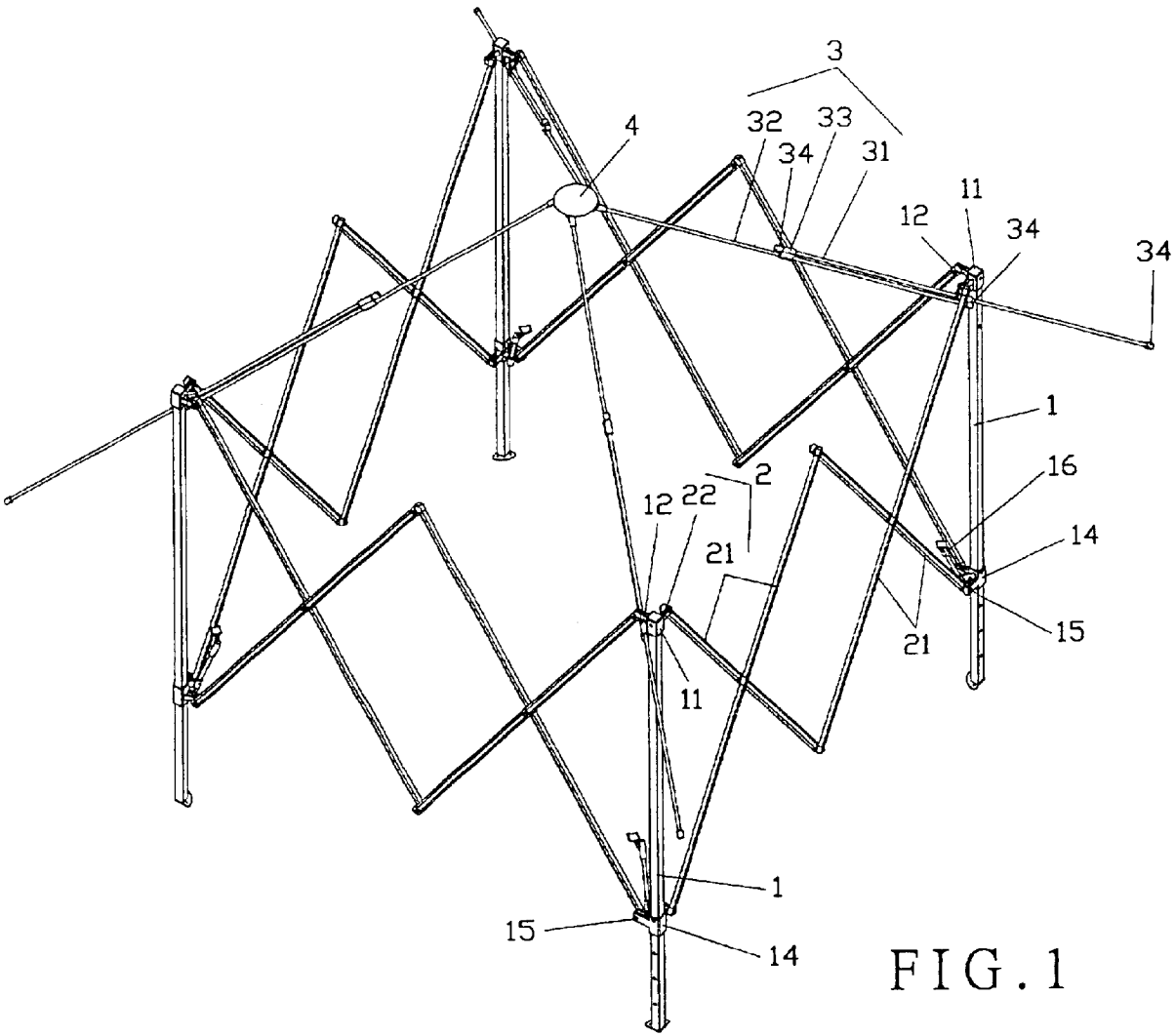
FIG. 1 is a perspective view of the present invention.

Reference is now made to FIG. 1 of the tent structure of the present invention, which is generally composed of four posts 1, four scissor-like linking rod sets 2, four retractable rod sets 3, and a connector 4.

Figure 2:
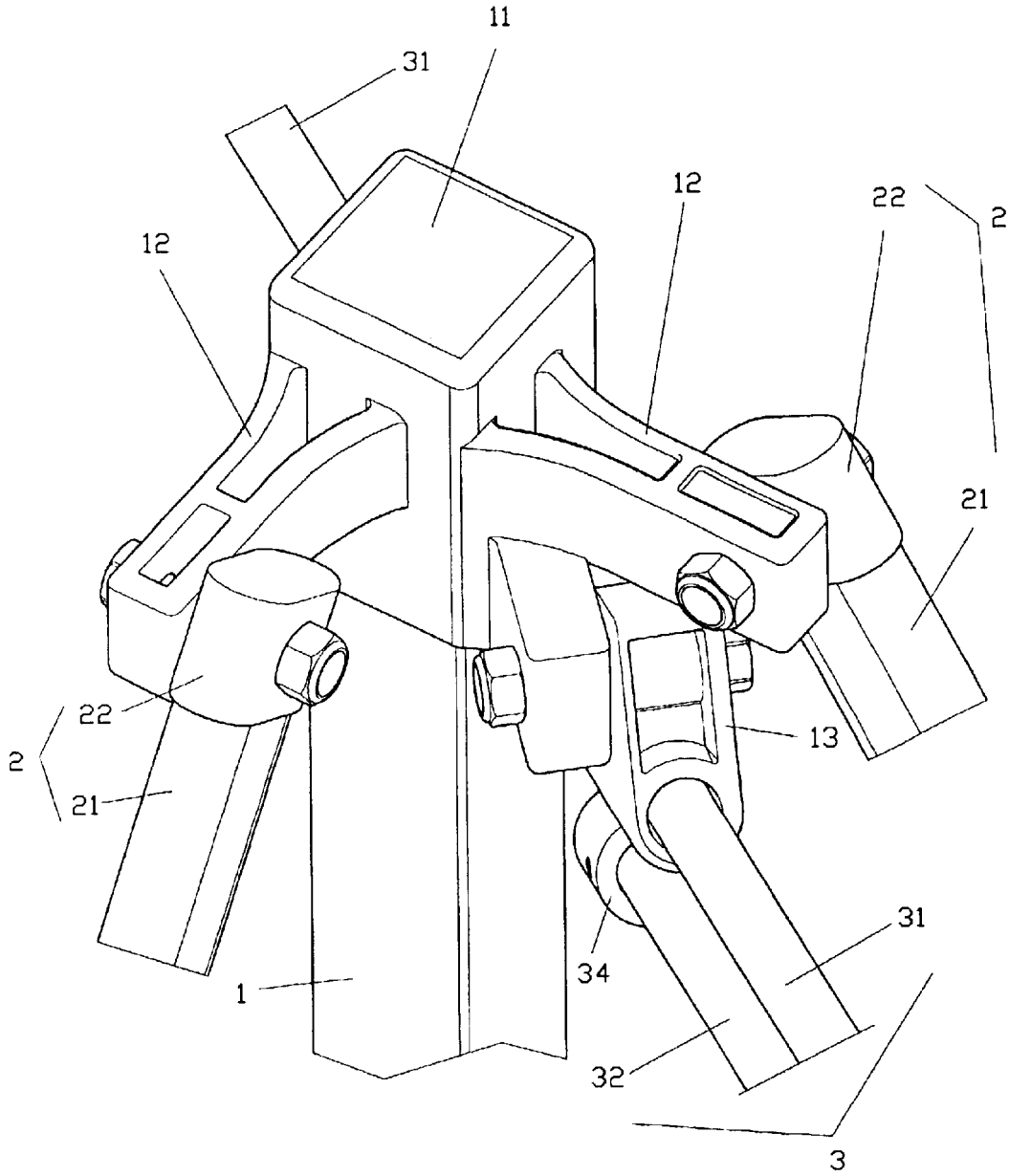
FIG. 2 is an enlarged view of a fixture of the present invention.
Figure 3:
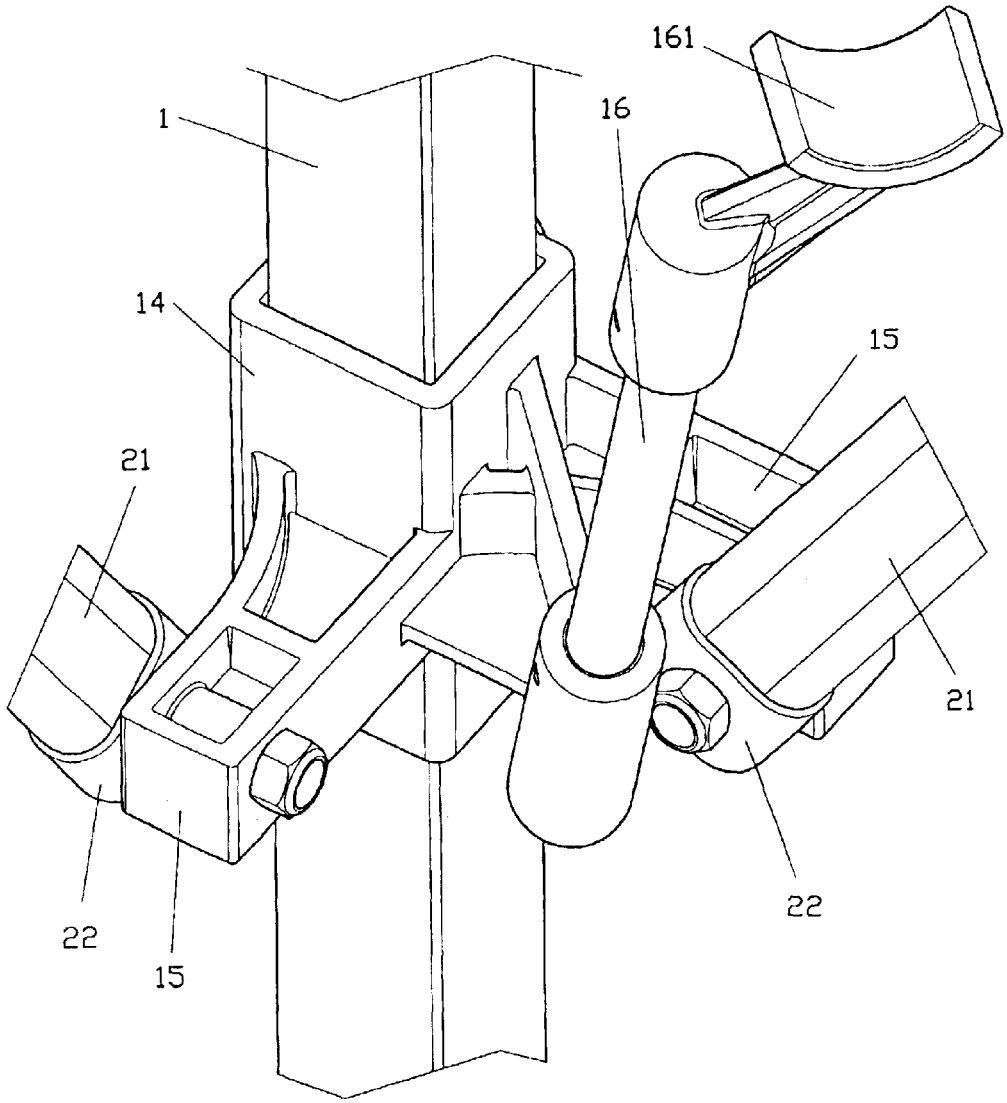
FIG. 3 is an enlarged view of a sliding seat of the present invention.

The four posts 1 stand on four corners of the tent, as shown in FIG. 2. Each post 1 has a fixture 11 on the top thereof with a pair of connecting lugs 12 on two sides next to each other. A sleeve 13 is formed between the connecting lugs 12. As shown in FIG. 3, a sliding seat 14 sleeves on the post 1 with a pair of connecting lugs 15 on two sides next to each other corresponding to the connecting lugs 12 of the fixture 11. A supporting rod 16 is upwardly provided between the two connecting lugs 15 with a supporting arm 161 at the top end thereof.

The four scissor-like linking rod sets 2 are secured between the four posts 1, respectively. Each scissor-like linking rod set 2 comprises four rods 21, and every two rods 21 are connected at the center portion thereof to form an X-shaped set. A top and a lower ends at one side of one X-shaped set is connected with a top and a lower ends of another X-shaped set. Each scissor-like rod set comprises connecting ends on the top and the bottom of both sides.

Figure 4:
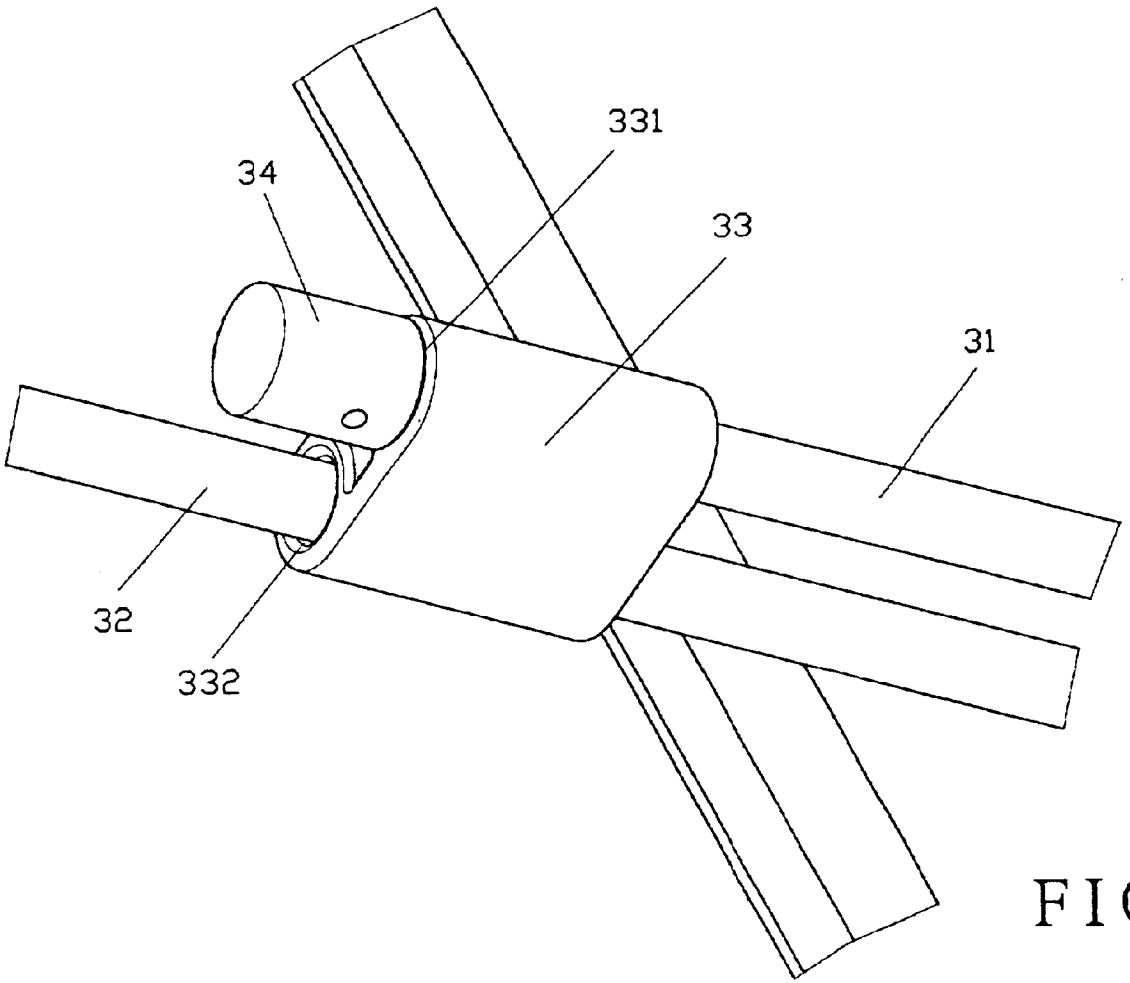
FIG. 4 is an enlarged view of a glove of the present invention.
Figure 5:
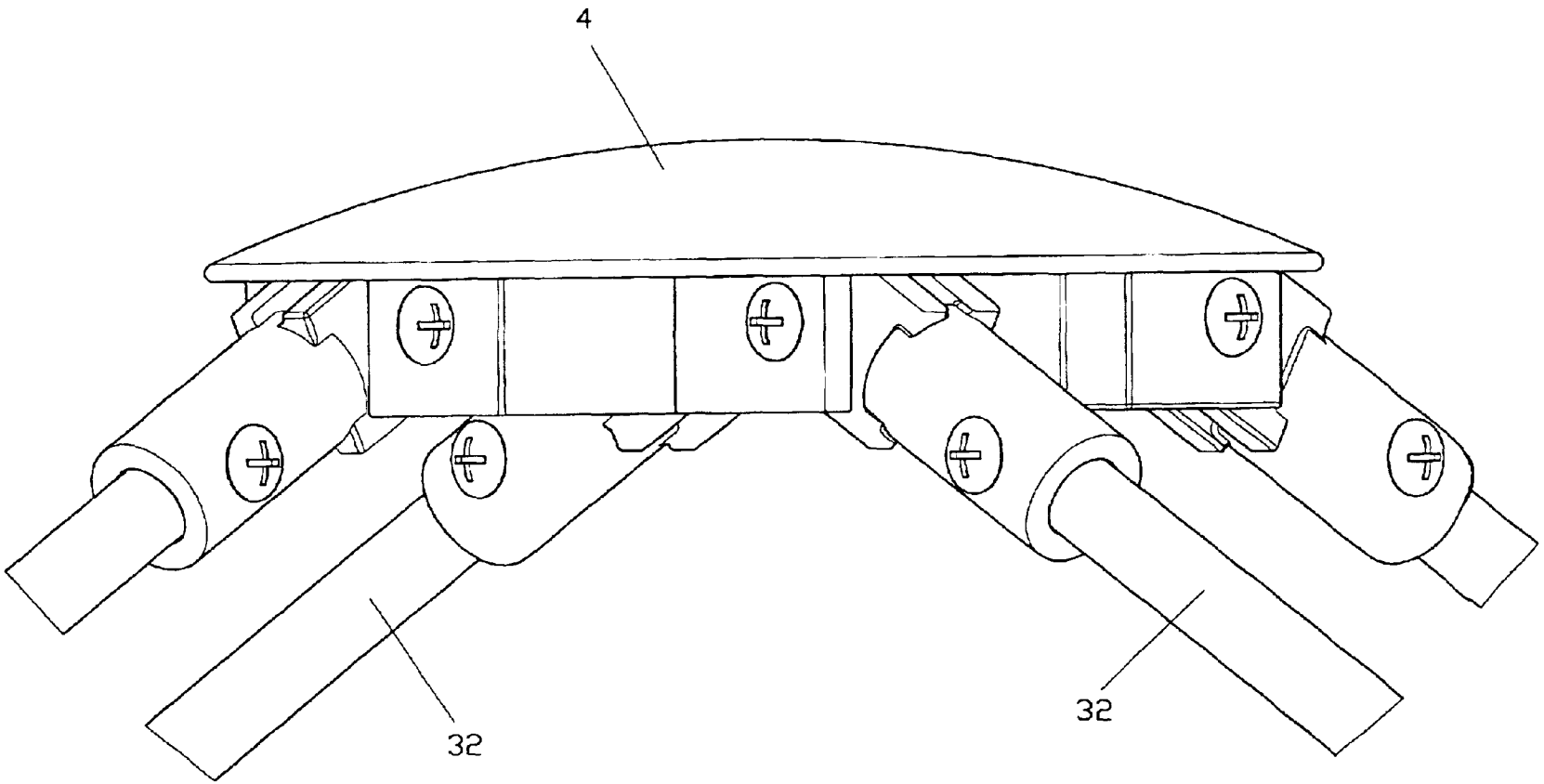
FIG. 5 is an enlarged view of a connector of the present invention.

As shown in FIG. 4, each retractable rod set 3 comprises a first rod member 31, a second rod member 32, a glove 33 and blocks 34. The glove 33 has a first slot 331 and a second slot 332 in parallel with each other. The first rod member 31 comprises a pair of blocks 34 at respective ends and is inserted through the sleeve 13 of the post 1 and the first slot 331 of the glove 33. The blocks 34 on the first rod member 31 prevent the first rod member 31 from detaching from the sleeve 13 and the first slot 331. The second rod member 32 is inserted through the second slot 332 with a block 34 at one end to prevent the end of the second rod member 32 from detaching. The other end of the second rod member 32 is pivoted to the connector 4 as shown in FIG. 5. Both the first rod member 31 and the second rod member 32 are formed with elastic material, such as fiberglass.

To assemble the present invention, the two lower connecting ends 22 of each scissor-like linking rod set 2 are pivoted to the connecting lugs 15 of the sliding seat 14 of each post 1, respectively, and the two upper connecting ends 22 of each scissor-like linking rod set 2 are pivoted to the connecting lugs 12 of the fixture 11 of each post 1 to form a square structure. The first rod member 31 of each retractable rod set 3 is inserted through the sleeve 13 and the first slot 331 of the sleeve 33. The blocks 34 on the first rod member 31 prevent the first rod member 31 detaching from the sleeve 13 and the first slot 331. The second rod member 32 is inserted through the second slot 332 of the sleeve 33 and has the block 34 at one end to prevent from detaching. The other end of the second rod member 32 is pivoted to the connector 4. This completes the assembly.

Figure 6:
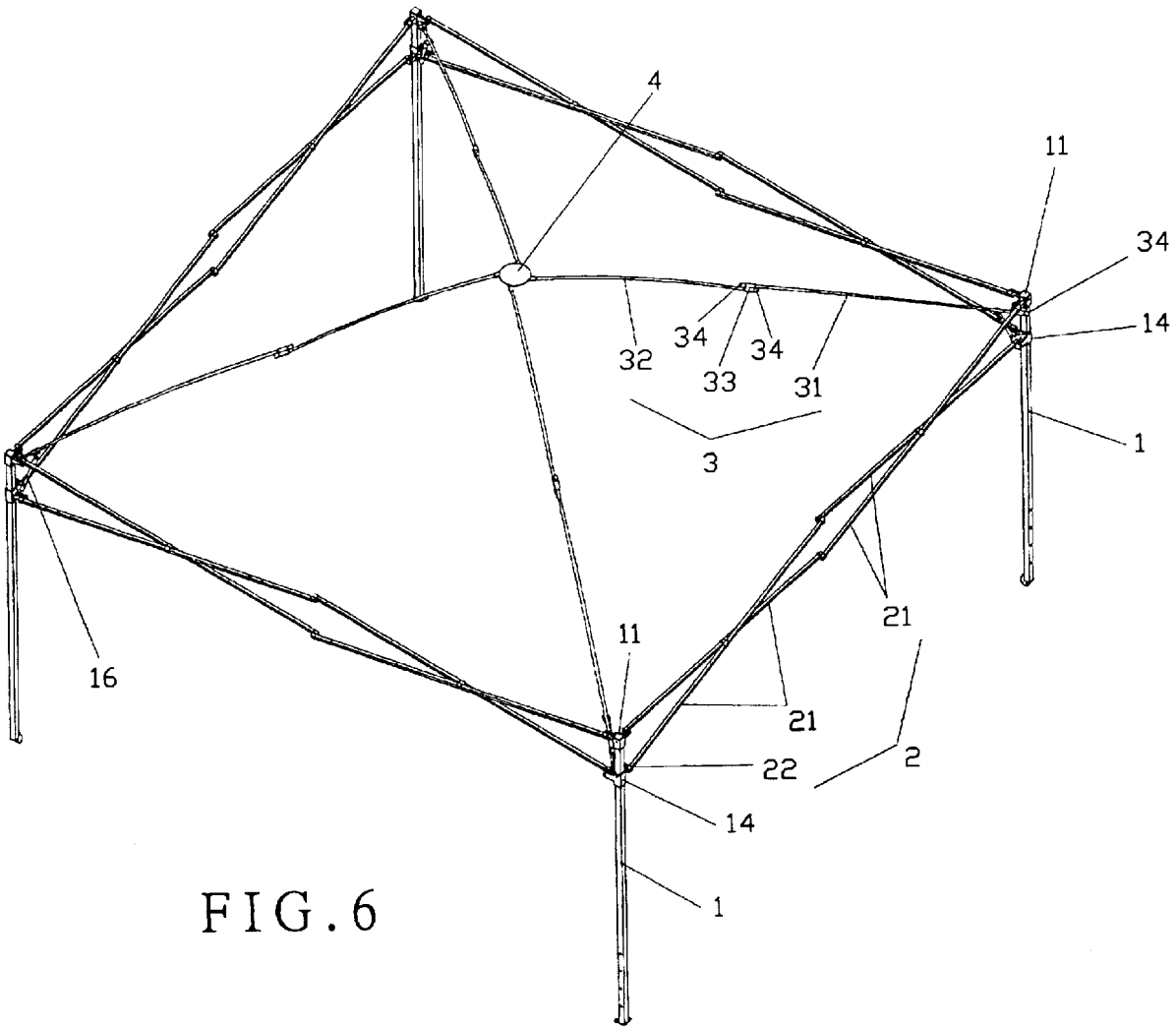
FIG. 6 is a perspective view of the tent structure of the present invention in a wide spreading status.
Figure 7:
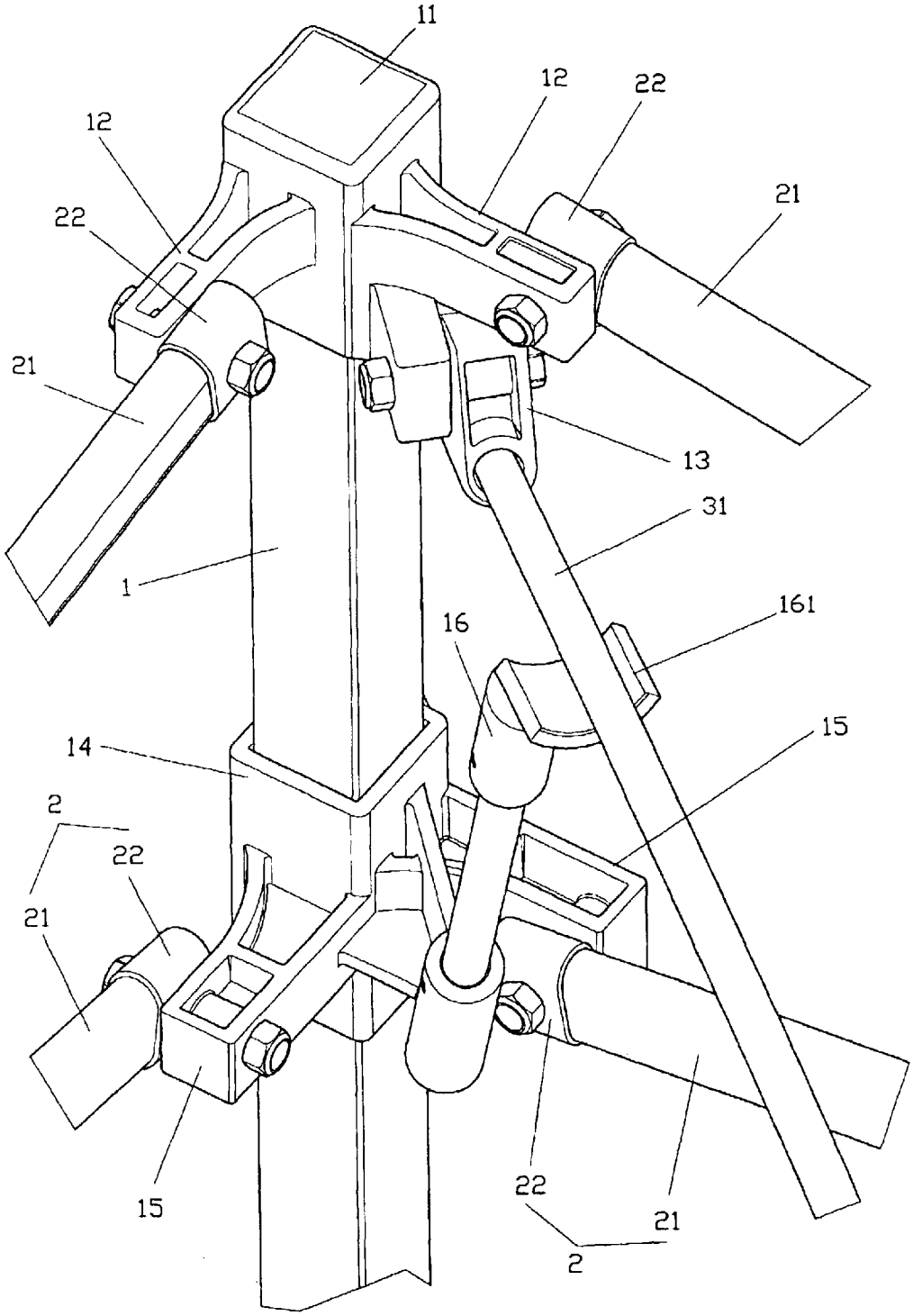
FIG. 7 is an enlarged view of the fixture and the sliding seat in an expanded position.
Figure 8:
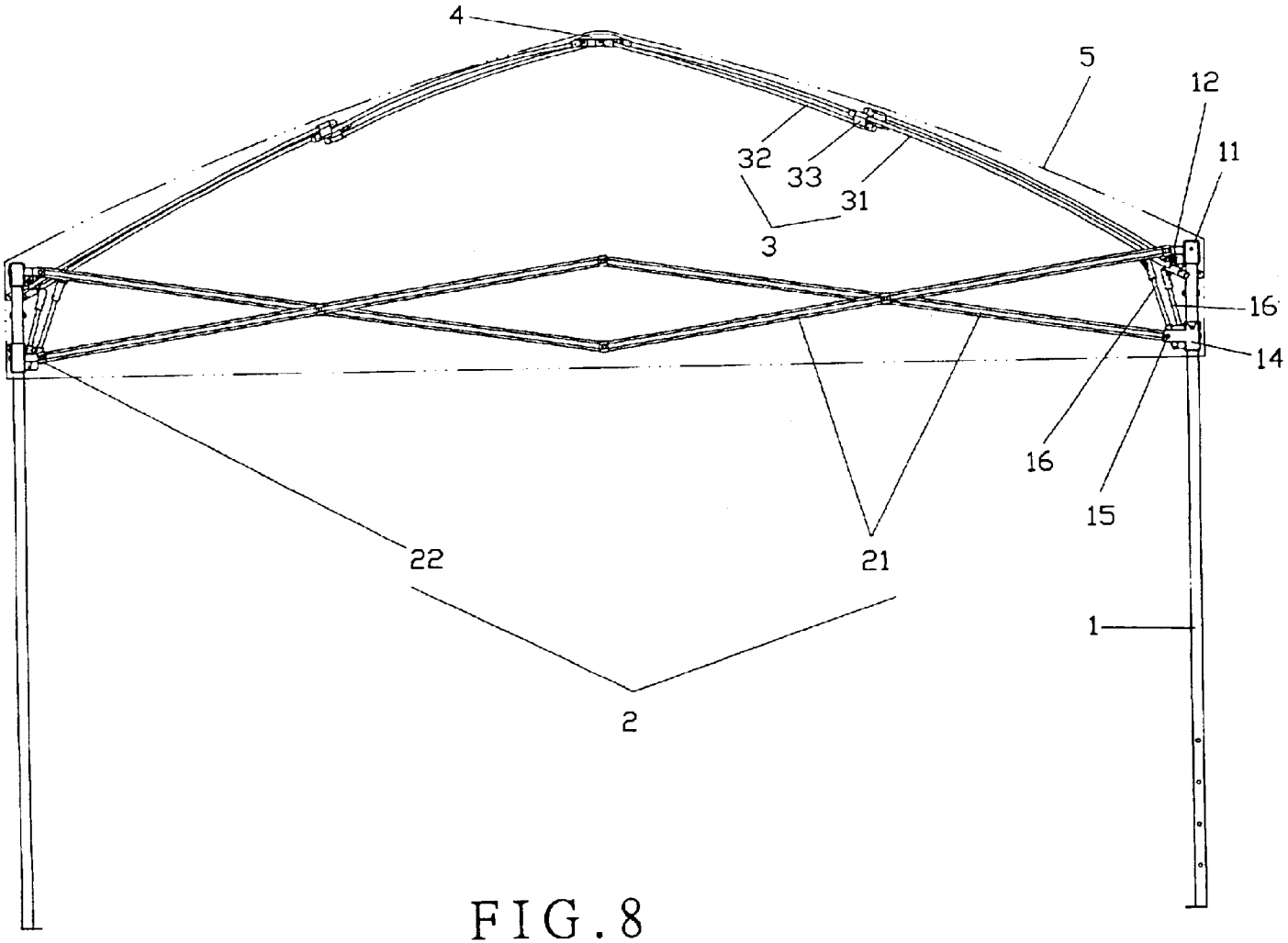
FIG. 8 shows the tent of the present invention covered with a canopy in a wide spreading status.

To operate the present invention, the four posts 1 are expanded wide, as shown in FIG. 6, which brings the four scissor-like linking rod sets 2 to expand as well, whereas the fixture 11 of each post 1 links the first rod member 31 of the retractable rod member 3 in the sleeve 13 to slide until the first rod member 31 and the second rod member 32 are in wide expansion. Due to the connector 4 being pivoted with one end of each second rod member 32 and the flexible character, the first rod member 31 and the second rod member 32 are formed in an arcuate shape. The sliding seat 14 on each post 1 slides upwardly simultaneously when expanding outwardly, as shown in FIG. 7. The supporting arm 161 of the supporting rod 16 provides a force to hold the first rod member 31. When the tent has expanded to its extent, an arcuate tent top is formed and covered with a canopy 5, which drains all rain on the top of the tent and minimizes the effects of wind blowing to provide a strong structure.

Figure 9:
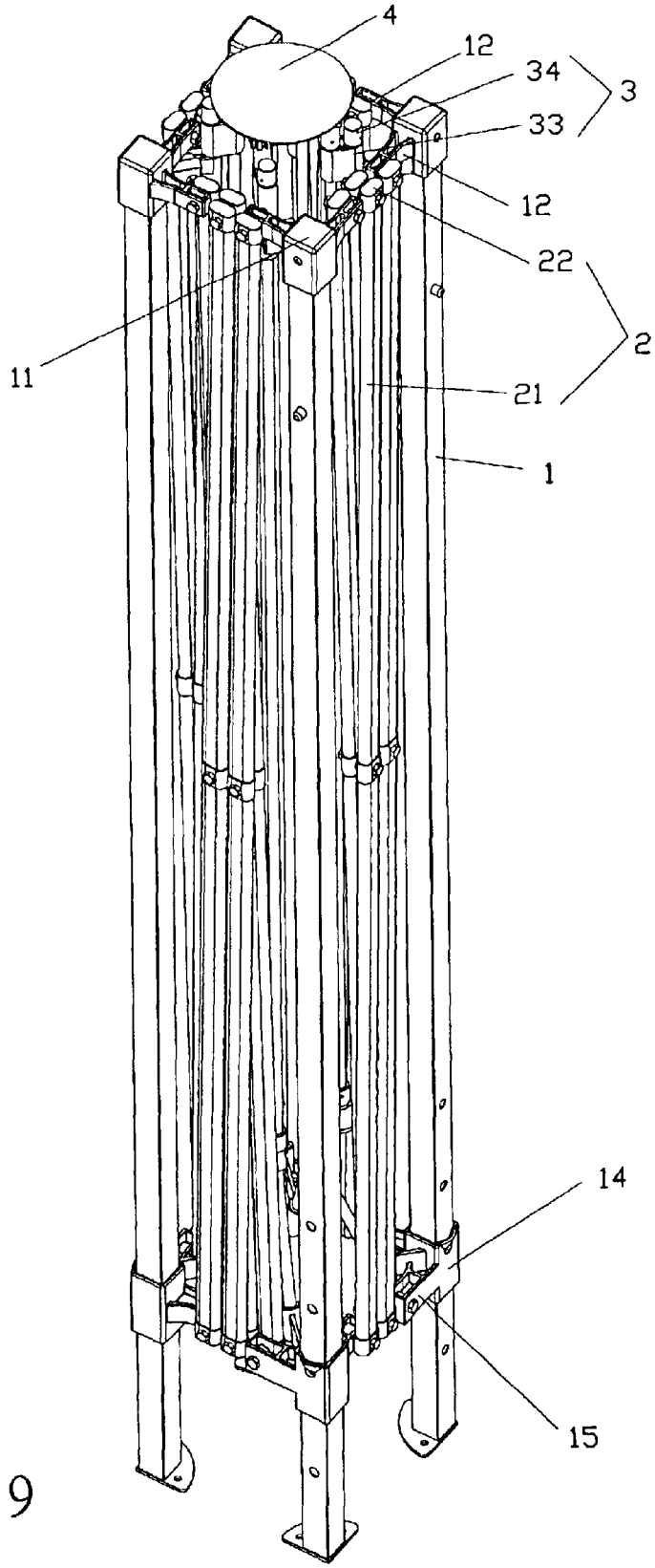
FIG. 9 is a perspective view to collapse the tent structure of the present invention.

To collapse the tent of the present invention, as shown in FIG. 9, the four posts 1 are collected inwardly, which brings the four scissor-like linking rod sets 2 to collapse and links the sliding seat 14 of each post 1 to slide downward. This links the first rod member 31 and the second rod member 32 to retract inwardly, until they have reached smaller size.

I claim:

1. A tent structure comprising four posts, four linking rod sets, four retractable rod sets and a connector, wherein said four posts stand on four corners of said tent, each said post comprising a fixture on a top thereof having a pair of connecting lugs extending therefrom, a sleeve formed between said connecting lugs, and a sliding seat sleeved on said post having a pair of connecting lugs corresponding to said connecting lugs of said fixture;

said four linking rod sets each extending between a pair of said four posts, each said linking rod set comprising four rods, each of said rods being connected at a center portion to form an X-shaped set with another of said rods, and a top and a lower end at one side of one X-shaped set being connected respectively with a top and a lower end of another X-shaped set, at least one said lower end of each said linking rod set being pivoted to one said connecting lug of said sliding seat of each said post, and at least one said top end of each said linking rod set being pivoted to one said connecting lug of said fixture of each said post;

said sliding seat comprising a supporting rod extending therefrom, said supporting rod comprising a supporting arm formed at a top end thereof for detachably engaging one said retractable rod set, each of said retractable rod sets having one end inserted in slidably displaceable manner through said fixture of one said post and another end pivoted to said connector.

2. The tent structure, as recited in claim 1, wherein each said retractable rod set comprises a first rod member, a second rod member adjustably joined to said first rod member by a glove, said glove comprising a parallel pair of first and second slots therein, said first rod member being inserted in slidably displaceable manner through said sleeve of said fixture and said first slot, said second rod member being inserted in slidably displaceable manner through said second slot at one end and at another end being pivoted to said connector.

3. The tent structure, as recited in claim 2, wherein said first rod member and said second rod member of said retractable rod set are made of elastic material.

4. The tent structure, as recited in claim 2, wherein each of said first and second rod members includes a block disposed at least at one end thereof for limiting the displacement thereof relative to said glove.

5. A tent structure comprising a plurality of corner posts disposed about a connector, a plurality of retractable rod sets respectively extending between said posts and said connector, and a plurality of linking rod sets each extending between a pair of said posts;

each said post comprising a fixture on a top thereof having a pair of connecting lugs extending therefrom a sleeve formed between said connecting lugs, and a sliding seat sleeved on said post having a pair of connecting lugs corresponding to said connecting lugs of said fixture;

each said linking rod set comprising a plurality of rods forming at least one collapsibly extended X-shaped set;

each of said retractable rod sets having one end inserted in slidably displaceable manner through said fixture of one said post and another end pivoted to said connector, said sliding seat including a supporting rod extending therefrom, said supporting rod terminating at a free end forming a supporting arm for detachably engaging one said retractable rod set coupled to said fixture of one said post.

6. The tent structure, as recited in claim 5, wherein each said retractable rod set comprises a first rod member, a second rod member adjustably joined to said first rod member by a glove, said glove comprising a parallel pair of first and second slots therein, said first rod member being inserted in slidably displaceable manner through said sleeve of said fixture and said first slot, said second rod member being inserted in slidably displaceable manner through said second slot at one end and at another end being pivoted to said connector.

* * * * *